US008307898B2

(12) United States Patent
Johnson et al.

(10) Patent No.: US 8,307,898 B2
(45) Date of Patent: Nov. 13, 2012

(54) METHOD AND APPARATUS FOR CEMENTING A LINER IN A BOREHOLE USING A TUBULAR MEMBER HAVING AN OBSTRUCTION

(75) Inventors: Mark O. Johnson, Anchorage, AK (US); Robert D. Harris, Willow, AK (US)

(73) Assignees: BP Corporation North America Inc., Houston, TX (US); Baker Hughes Incorporated, Houston, TX (US)

( * ) Notice: Subject to any disclaimer, the term of this patent is extended or adjusted under 35 U.S.C. 154(b) by 268 days.

(21) Appl. No.: 12/640,942

(22) Filed: Dec. 17, 2009

(65) Prior Publication Data

US 2010/0181079 A1 Jul. 22, 2010

Related U.S. Application Data

(60) Provisional application No. 61/203,567, filed on Dec. 23, 2008.

(51) Int. Cl.
*E21B 33/12* (2006.01)

(52) U.S. Cl. ..... 166/285; 166/290; 166/177.4

(58) Field of Classification Search ..... 166/285, 166/290, 177.4
See application file for complete search history.

(56) References Cited

U.S. PATENT DOCUMENTS

| | | | | |
|---|---|---|---|---|
| 5,803,173 | A * | 9/1998 | Fraser et al. | 166/291 |
| 6,595,288 | B2 * | 7/2003 | Mosing et al. | 166/285 |
| 6,799,638 | B2 * | 10/2004 | Butterfield, Jr. | 166/386 |
| 7,325,606 | B1 | 2/2008 | Vail, III et al. | |
| 7,784,552 | B2 * | 8/2010 | Brouse | 166/382 |
| 7,857,052 | B2 | 12/2010 | Giroux et al. | |
| 2008/0128128 | A1 | 6/2008 | Vail et al. | |
| 2010/0012320 | A1 | 1/2010 | Vail | |
| 2010/0218951 | A1 | 9/2010 | Harris et al. | |
| 2011/0061876 | A1 | 3/2011 | Johnson | |

* cited by examiner

*Primary Examiner* — William P Neuder
(74) *Attorney, Agent, or Firm* — John L. Wood

(57) ABSTRACT

A method and apparatus are disclosed for cementing a liner in place in an open borehole using a tubular member having at least one obstruction in the tubular member to pass the cement into the liner and through the liner into an annular space surrounding the liner to position the liner in the open borehole.

41 Claims, 14 Drawing Sheets

METHOD AND APPARATUS FOR CEMENTING A LINER IN A BOREHOLE USING A TUBULAR MEMBER HAVING AN OBSTRUCTION

CROSS REFERENCE TO RELATED APPLICATION

This application claims benefit of U.S. Provisional Patent Application Ser. No. 61/203,567, filed Dec. 23, 2008, the teachings of which are incorporated herein by reference in their entirety.

FIELD OF THE INVENTION

The present invention relates to a method and apparatus for cementing a liner in place in an open borehole using a tubular member having an obstruction in the tubular member where cement is passed through the tubular member into the liner and through the liner into an annular space surrounding the liner to position the liner in the open borehole.

BACKGROUND OF THE INVENTION

In the drilling and completion of boreholes from a wellbore it is necessary to cement liners in place in the boreholes to enable the completion of the well for the production of fluids from the subterranean formation penetrated by the borehole. The boreholes may be lateral wells drilled from a wellbore using a whipstock at any desired angle or orientation or they may be wells which extend below the bottom of the well portion drilled by conventional means. Tubular members, such as drillpipe and coiled tubing are widely used for drilling such boreholes.

Tubular members can be used to cement a liner in place in a borehole. Typically the cement is injected through the tubular member into the liner with the cement then passing out of the end of the liner at the end of the liner and then into the annulus between the outside of the liner and the inside of the borehole. This places cement around the liner so that perforation of the formation and the like can be accomplished as well as other operations if desirable.

Typically the liner may be maintained in a central position in the borehole by the use of centralizers, as known to those skilled in the art. In such completions, the cement is passed downwardly through the tubular member and through a liner wiper plug having an opening and a passage therethrough so as to inject the cement into the liner and into the annular space around the outside of the liner and the inside of the borehole.

As the cement is injected, a cement cleanout fluid is used to push a tubular member wiper dart, which separates the cement from the cement cleanout fluid, through the tubular member downwardly and into the liner. When the cement cleanout fluid has pushed the tubular member wiper dart into the liner wiper plug, the tubular member wiper dart contacts and plugs the opening in the liner wiper plug and the combined dart/plug becomes impermeable to fluid flow into the liner, thereby resulting in the dart/plug combination being pushed through the liner and forcing the cement in the liner to its toe end and then into the annular space around the liner. The cleanout fluid is separated from the cement by the combined wiper dart and liner wiper plug. The cement cleanout fluid may be pushed through the tubular member by drilling mud or any other suitable liquid. This is a commonly used procedure to cement liners in place in subterranean boreholes and the like. Unfortunately this procedure is not suitable for use with a tubular member containing an obstruction, since the obstruction inhibits or otherwise prohibits travel of the tubular member wiper dart.

Frequently coiled tubing (a tubular member) including a wire, cable or a bundle of wires, is used for drilling lateral boreholes or other operations within the wellbore. It will be immediately apparent that the procedure just discussed is not effective to cement liners in wells using a tubular member, including a wire, since the wire makes it impossible to pass the tubular member wiper dart through the tubular member. Similarly drillpipe, which is also a suitable tubular member, is not effective when the drillpipe includes an obstruction which makes it impossible to use a drillpipe member wiper dart.

Accordingly, when tubular member drilling techniques are used it has been necessary to change out the tubular member containing the wire for a tubular member containing no wire prior to cementing liners into place. This has been a necessary operation and can be quite expensive and time consuming. The cost to make this exchange has been estimated to typically run in the neighborhood of $100,000 per exchange.

Accordingly a continuing effort has been made to discover ways of cementing liners in boreholes using tubular members containing obstructions without changing out the tubular members containing obstructions.

SUMMARY OF THE INVENTION

According to the present invention, a method has been found for cementing a liner having a (heel) top end and a (toe) bottom end positioned in an open borehole extending from a wellbore produced by drilling with a drilling apparatus including a tubular member having at least one obstruction in the tubular member, the method comprising:

- injecting cement into the liner through the tubular member;
- passing a cement cleanout fluid through the tubular member to move the cement through the tubular member;
- the cement and cement cleanout fluid forming a cement cleanout fluid/contaminated cement fluid interface material, to a selected distance upstream from the top end of the liner;
- stopping injection before any cement cleanout fluid/contaminated cement enters the liner;
- closing the flow path of fluids down the liner at the top end of the liner at or near the liner wiper plug;
- discharging the cement and cement contaminated by the cement cleanout fluid remaining in the tubular member above the liner wiper plug into an annular space between an outer surface of the tubular member and inner surface of the wellbore above the top of the liner;
- discharging additional cement cleanout fluid from the tubular member to move contaminated cement further up the annulus;
- shutting off flow to the annulus,
- releasing the liner wiper plug;
- resuming flow down the liner by passing fluid through the tubular member to push the liner wiper plug to the toe end of liner; and
- reestablishing flow to the annulus above the top of the liner so additional fluid passed by the tubular member can fully remove contaminated cement from wellbore.

The invention in another aspect is directed to a method for cementing a liner in position in an open borehole extending from a wellbore and produced by drilling using a drilling apparatus including a tubular member having at least one obstruction in the tubular member, the cement being supplied through the tubular member, the method comprising:

positioning a liner in the open borehole, the liner extending from a toe end of the liner near a toe end of the open borehole to a deployment sleeve being positioned on a top end of the liner and located within casing or production tubing, the deployment sleeve being adapted to matingly connect to a liner running tool, the liner running tool including an extension having a passageway through the liner running tool and the extension and a liner wiper plug having an opening extending therethrough with the extension extending through the opening, a cover biased to cover the opening when the extension is withdrawn and a releasable retaining apparatus adapted to releasably retain the liner wiper plug in a selected position in the liner;

positioning the liner running tool in fluid communication with the deployment sleeve;

injecting cement into the liner through the tubular member and the liner running tool in a selected amount greater than required to fill an annular space between an outside of the liner and the inside of the open borehole and to a level above the deployment sleeve;

injecting a cement cleanout fluid in contact with the cement through the tubular member in an amount sufficient to displace the selected amount of cement into the liner and the annular space outside the liner;

stopping injection of the cement cleanout fluid prior to injecting cement cleanout fluid through the liner wiper plug, removing the liner running tool to a position above the deployment sleeve, withdrawing the extension from the liner wiper plug, closing the cover and passing additional cement cleanout fluid through the passageway to pass excess cement and cement contaminated with cement cleanout fluid up the wellbore and outside the tubular member;

retracting the extension to a suitable length to permit positioning the liner running tool in the deployment sleeve and releasing the liner wiper plug;

injecting additional cement cleanout fluid through the liner running tool to move the liner wiper plug to the toe end of the liner and fill the liner upstream of the liner wiper plug with cement cleanout fluid; and, releasing the liner running tool from the deployment sleeve and continuing to inject additional cement cleanout fluid to move contaminated cement up the wellbore outside the tubular member.

The invention also is directed to an apparatus for cementing a liner in an open borehole extending from a wellbore and produced by drilling using a drilling apparatus including a tubular member having at least one obstruction in the tubular member. The apparatus comprises:

a liner running tool adapted to be run down the wellbore on the tubular member and including a body configured for mating connection to the liner, the body including an extension having a passageway through the liner running tool and the extension to permit fluid flow through the liner running tool;

a liner wiper plug having an opening extending therethrough and adapted to receive the extension of the body extending through the opening on the liner wiper plug, a cover positioned on the liner wiper plug and adapted to cover the opening on the liner wiper plug when the extension of the body is withdrawn from the opening and a releasable retaining apparatus for the liner wiper plug and adapted to releasably retain the liner wiper plug in a selected position in the liner.

In another aspect, the invention is directed to a method for cementing a liner having a (heel) top end and a (toe) bottom end in position in an open borehole extending from a wellbore produced by drilling with a drilling apparatus including a tubular member having at least one obstruction in the tubular member. The tubular member has a discharge end fluidly connected to a passageway in a liner wiper plug positioned within the liner at the heel end of the liner such that fluids conveyed by the tubular member may be injected into the liner. The liner wiper plug has a valve operable to discontinue flow through the passageway. The tubular member and the heel end of the liner are located within the wellbore that extends upwardly such that fluids from the well may be conveyed to the earth's surface through the wellbore. The method comprises:

a) injecting cement into the liner through the tubular member and the liner wiper plug;

b) passing a cement cleanout fluid through the tubular member to move the cement through the tubular member such that an interface between the cement and the cement cleanout fluid is a selected distance upstream from the toe end of the liner;

c) discontinuing fluid communication between the tubular member and both the heel end of the liner and the liner wiper plug and closing the valve on the liner wiper plug positioned in the heel end of the liner;

d) passing the cement cleanout fluid through the tubular member to discharge the cement above the selected distance and cement contaminated by the cement cleanout fluid from the tubular member up the production tubing; and e) reestablishing fluid communication between the tubular member and the heel end of the liner and passing additional cement cleanout fluid through the tubular member to pass the liner wiper plug through the liner and thereby displace cement from the liner into an annular space outside the liner and an inside surface of the open borehole.

In another aspect, the invention concerns a method for cementing a liner in position in an open borehole extending from a wellbore and produced by drilling using a drilling apparatus including a tubular member having an outside surface and having at least one obstruction in the tubular member. The cement is supplied through the tubular member which is positioned within production tubing having an inside surface and extending upwardly through the wellbore such that fluids from the well may be conveyed to the earth's surface by the production tubing. The method comprises:

a) positioning a liner in the open borehole, the liner extending from a toe end of the liner near a toe end of the open borehole to a deployment sleeve positioned on a heel end of the liner and located in the production tubing, the deployment sleeve being adapted to sealingly connect to a liner running tool, the liner running tool including an extension and having a passageway through the liner running tool and the extension, the heel end of the liner having a liner wiper plug with an opening therein extending through the liner wiper plug so that fluids may be conveyed therethrough, the extension of the liner running tool being in fluid communication with and extending through the opening so that fluids conveyed by the tubular member may be conveyed through the passageway and the opening through the liner wiper plug, the liner wiper plug having a cover biased to cover the opening and restrict flow of fluids through the opening when the extension is withdrawn from the opening and a releasable retaining apparatus adapted to releasably retain the liner wiper plug in a selected position in the liner;

b) positioning the liner running tool in fluid communication with the deployment sleeve;

c) injecting cement into the liner through the tubular member and the liner running tool in a selected amount greater than required to fill an annular space between an outside of the liner and an inside of the open borehole such that cement is at a level within the tubular member above the deployment sleeve;

d) injecting a cement cleanout fluid in contact with the cement through the tubular member in an amount sufficient to displace the selected amount of cement into the liner and the annular space outside the liner within the open borehole;

e) stopping injection of the cement cleanout fluid prior to injecting cement cleanout fluid through the liner wiper plug, f) removing the liner running tool to a position above the deployment sleeve and sufficient to release the liner running tool from being in fluid communication with the deployment sleeve, thereby withdrawing the extension from the liner wiper plug and closing the cover to the opening of the liner wiper plug;

g) passing additional cement cleanout fluid through the passageway to pass excess cement and cement contaminated with cement cleanout fluid up the wellbore within an annulus defined by the outside surface of the tubular member and inside surface of the production tubing;

h) retracting the extension to a suitable length to permit repositioning of the liner running tool in the deployment sleeve and reestablishing fluid communication between the liner running tool and the deployment sleeve;

i) injecting additional cement cleanout fluid through the liner running tool to move the liner wiper plug to the toe end of the liner and fill the liner upstream of the liner wiper plug with cement cleanout fluid; and, j) releasing the liner running tool from the deployment sleeve and continuing to inject additional cement cleanout fluid to move contaminated cement up the wellbore within the annulus defined by the outside surface of the tubular member and inside surface of the production tubing.

DESCRIPTION OF PREFERRED EMBODIMENTS

In the discussion of the Figures which follows, the same numbers will be used throughout to refer to the same or similar components. Various components are shown schematically which are otherwise considered to be well known to those skilled in the art for simplicity.

The method and apparatus of the present invention are useful with coiled tubing or other tubular members used for cementing liners in position in boreholes, such as drillpipe. For illustration, the method and apparatus are shown and discussed by reference to a coiled tubing system working through production tubing. The use of the method and apparatus is essentially the same with or without the production tubing.

Figure 1A:
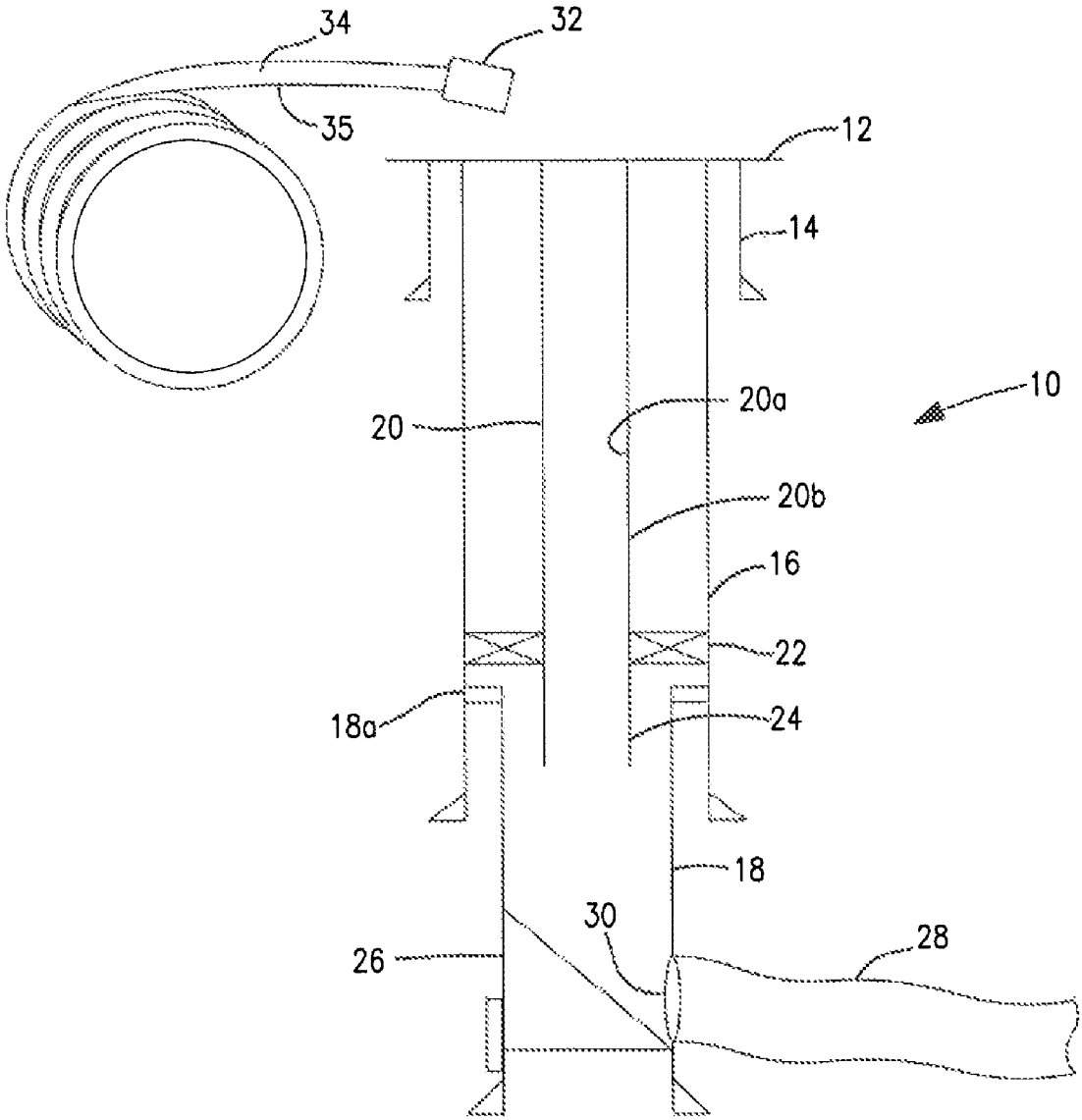
FIG. 1a PRIOR ART
FIGS. 1*a*)-1*e*) are schematic diagrams of a prior art method for cementing a liner in place in a borehole.

In FIGS. 1*a*)-1*e*) a prior art method for cementing a liner in a borehole is shown. The first step, shown as FIG. 1*a*), is the completion of a cased wellbore 10 which extends from an earth surface 12 to a subterranean formation and includes an outer casing 14, a second casing 16 and a third casing 18 supported from a casing hanger 18*a*). In many instances it may not be necessary to have three separate casings and it may be necessary to have more casings. Production tubing 20 is shown having an inside surface 20*a*) and an outside surface 20*b*). A packer 22 is shown in casing 16 and a bottom of production tubing 20 is shown at 24. It is noted that it is not necessary to have production tubing 20 for the apparatus and method. A whipstock 26 has been used to drill a lateral open hole 28 through an opening 30 in casing 18, which is typically milled through the casing using whipstock 26. Coiled tubing 34 is shown having an outside 35. A liner running tool 32 is shown attached to coiled tubing 34.

Figure 1B:
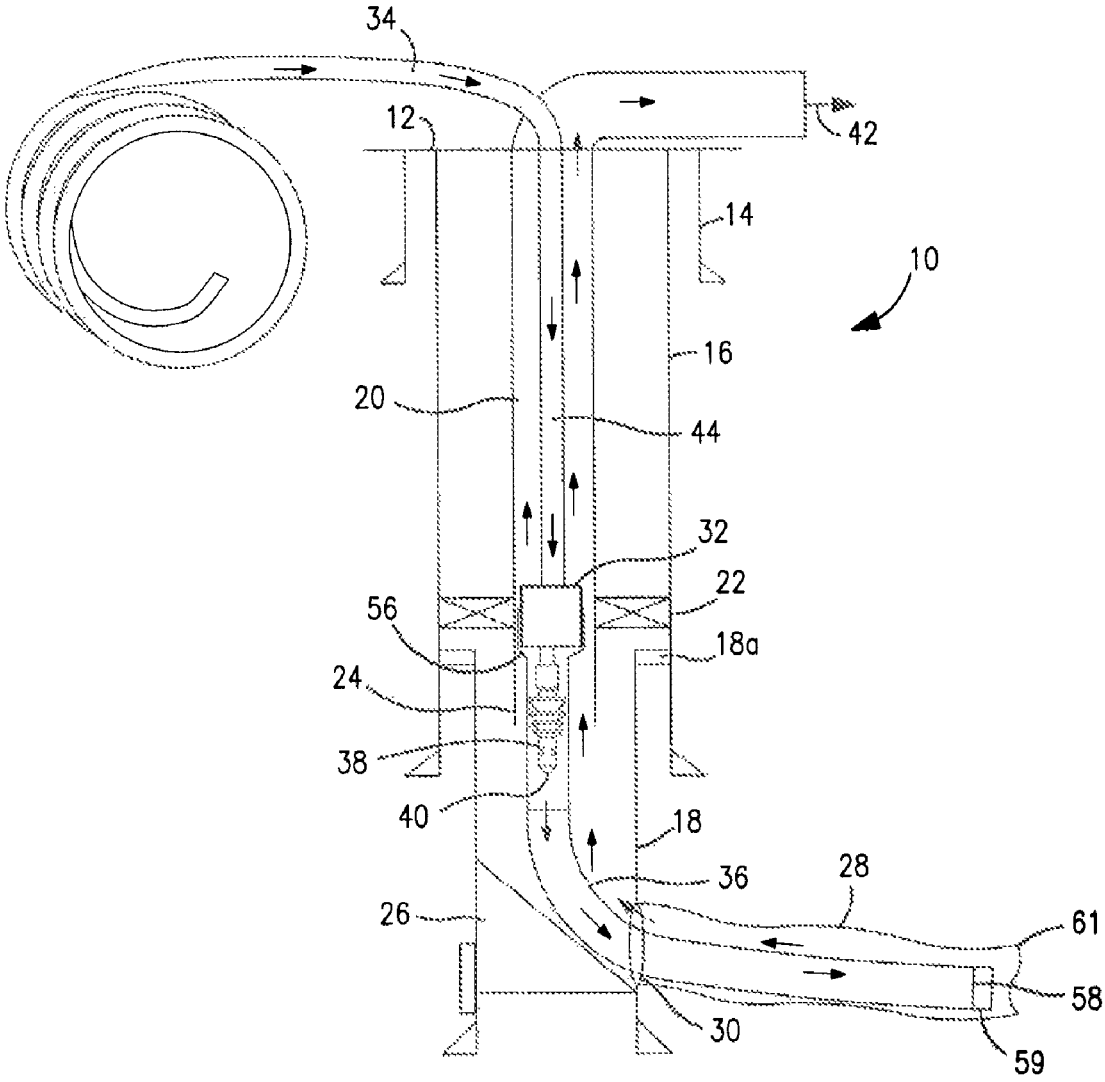
FIG. 1b PRIOR ART

In FIG. 1*b*), a jointed pipe liner 36 has been conveyed into the open hole 28 by coiled tubing 34. A liner running tool 32 and deployment sleeve 56 on a heel end of liner 36 serve to make the connection between the coiled tubing and the jointed pipe liner. A toe end 59 of liner 36 extends to near an end 61 of borehole 28. A liner wiper plug 38 is positioned beneath liner running tool 32 as shown. The smaller arrows show fluid (mud) flow in the system. Drilling mud 44 is circulated through liner running tool 32 and coiled tubing 34 into liner 36. The mud recovered is passed to recycle through a line 42 as shown.

Figure 1C:
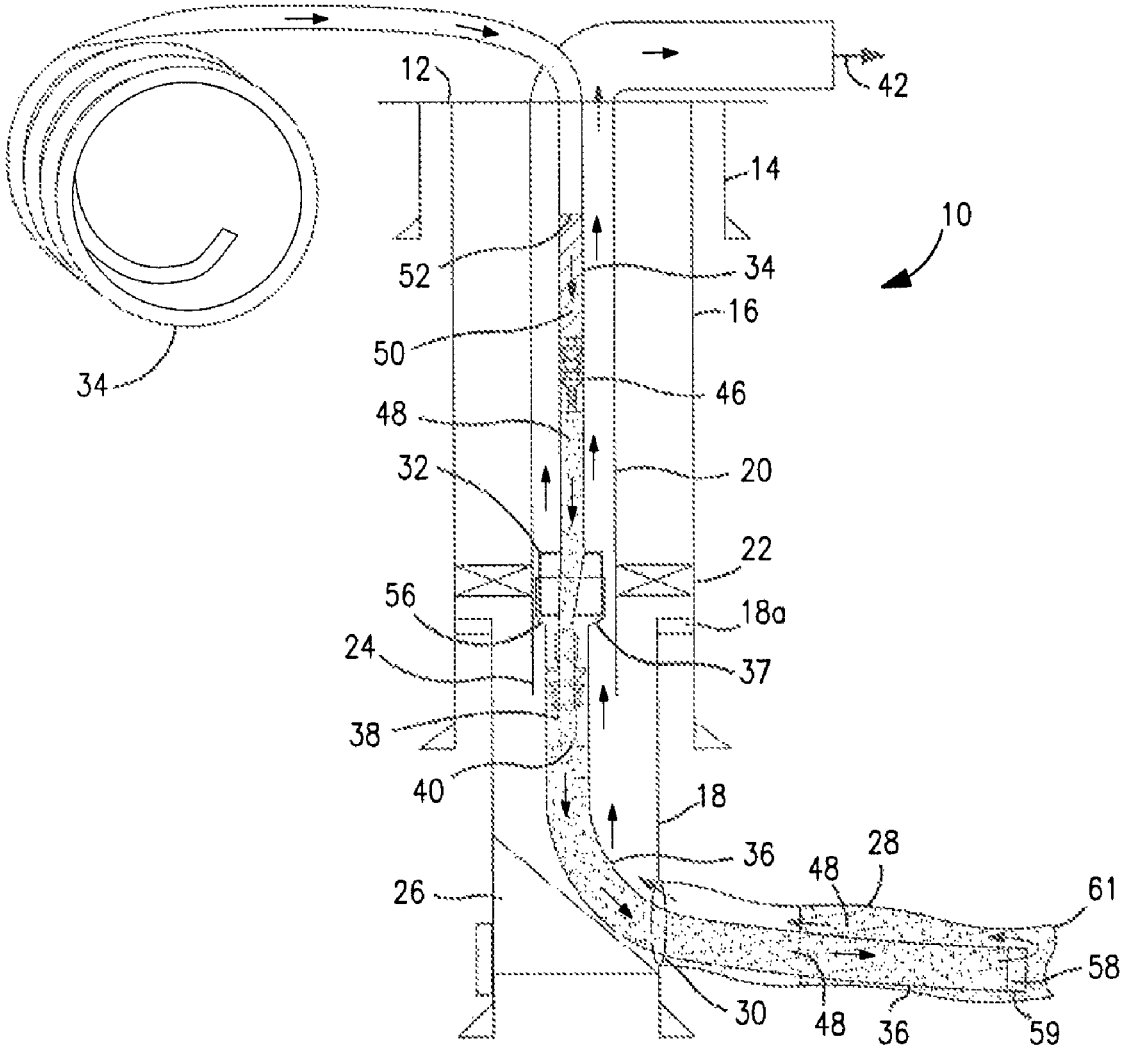
FIG. 1c PRIOR ART

As the cementing process is conducted, as shown in FIG. 1*c*), cement 48 is passed through tubular member 34 to liner running tool 32 through liner wiper plug 38 and into liner 36 and then around the annular space surrounding liner 36 in open hole 28.

A cement cleanout fluid 50 is shown in tubular member 34 to push a coil tubing wiper dart 46 through tubular member 34 to force cement 48 downwardly through tubular member 34 and liner running tool 32. When coil tubing wiper dart 46 encounters liner wiper plug 38, it locks into position with liner wiper plug 38 and becomes blocking with respect to fluid flow through liner wiper plug 38 and into the inside of liner 36. The combined wiper dart/wiper plug will now travel together down the liner.

Figure 1D:
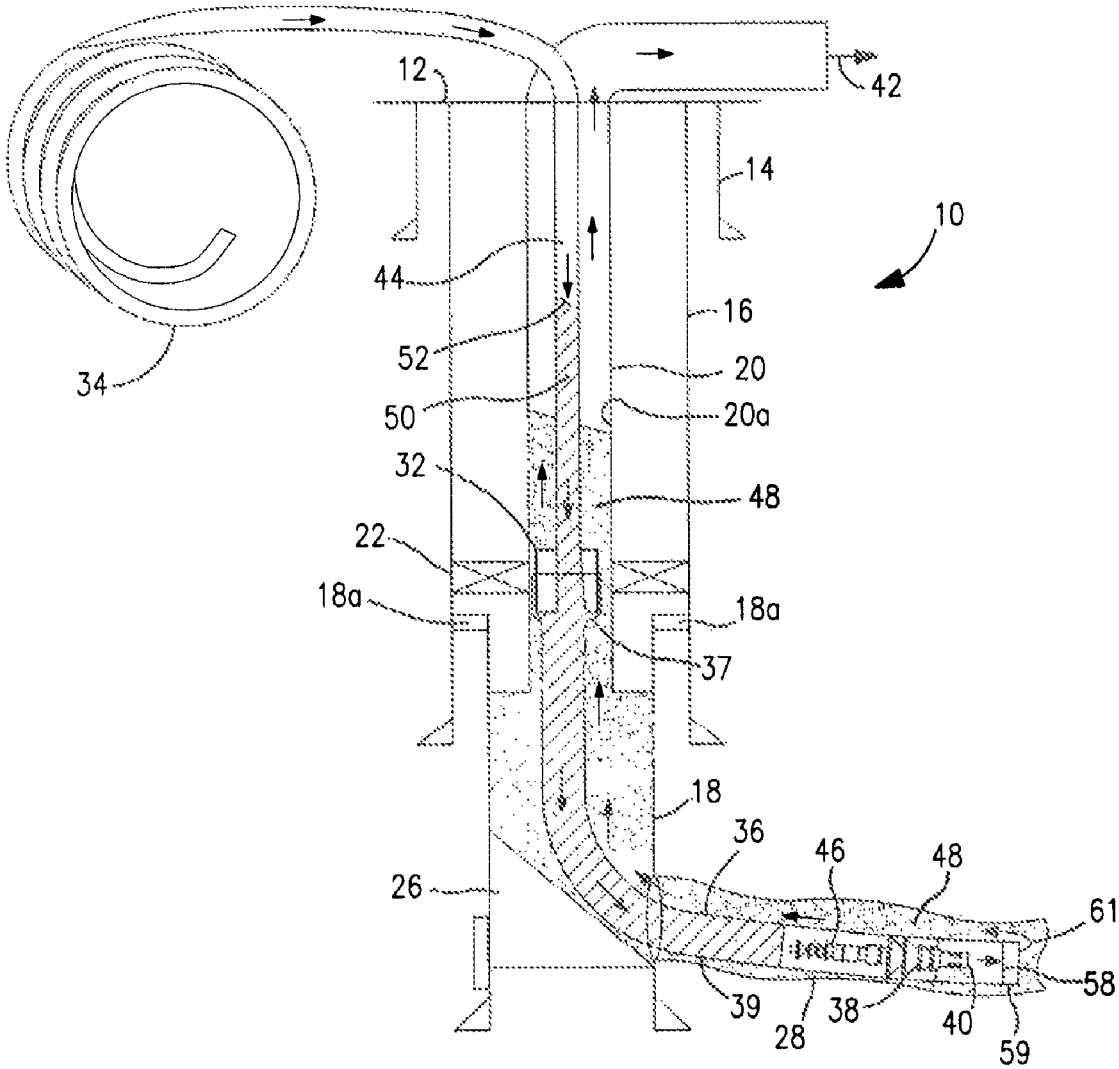
FIG. 1d PRIOR ART

As shown in FIG. 1*d*), the cement is then pushed by the cement cleanout fluid 50 separated from the cement 48 by the combined wiper dart/plug downwardly through the liner to ultimate discharge as shown at toe end 61 at the end of open hole 28. Cement discharged through a landing collar 58 at the toe end of the liner 36 passes upwardly through the annular space around the outside 39 of liner 36 and inside of borehole 28 and then upwardly into the production tubing through the annulus between the outside surface 35 of tubular member 34 and inside surface 20*a* of production tubing 20. This results in the liner being filled with cement cleanout fluid which is unable to contact cement 48 outside liner 36 or to exit liner 36 at its toe end 59.

Flow can no longer occur down the liner because the liner wiper plug has landed in the landing collar and created a seal.

Figure 1E:
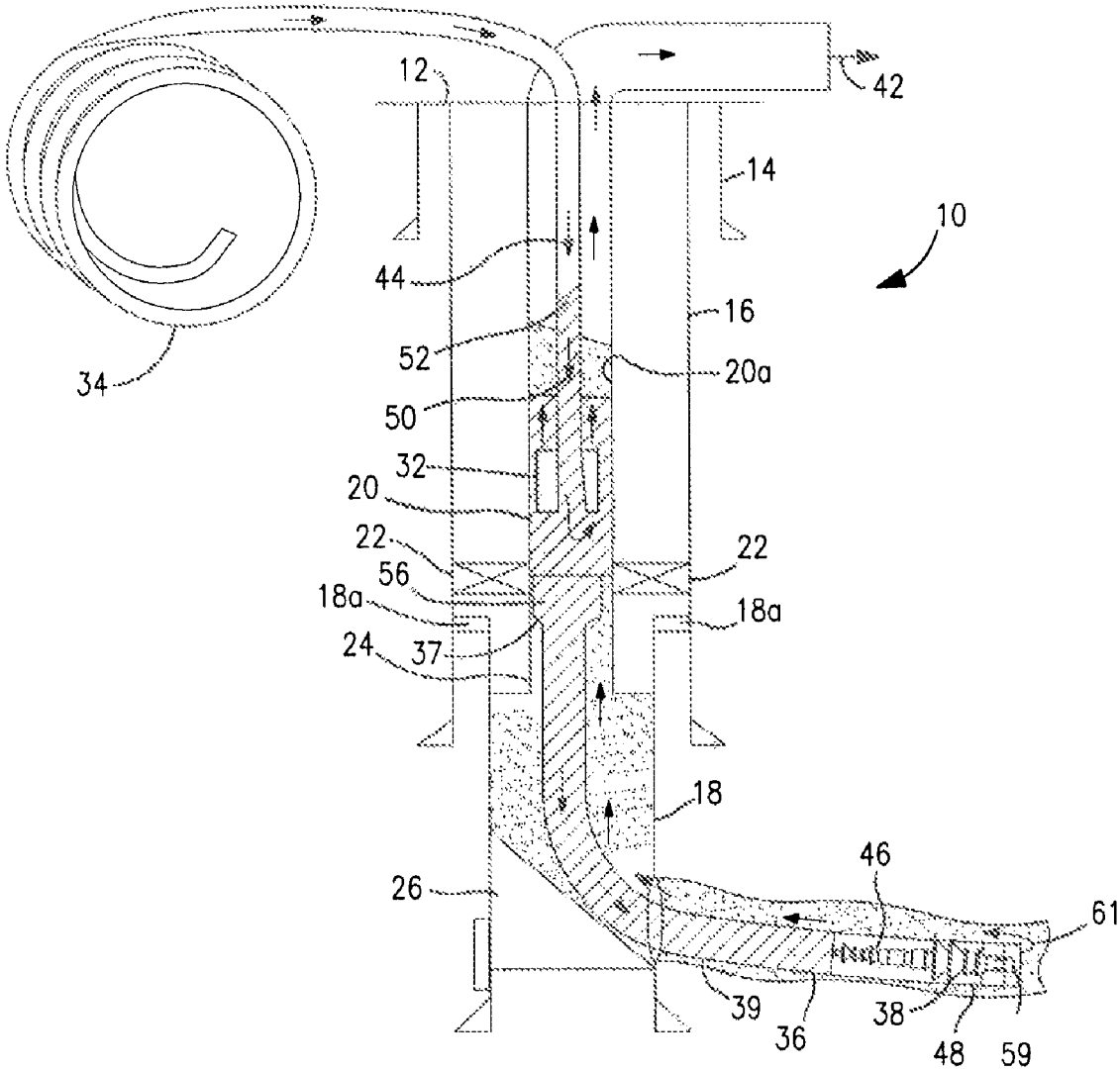
FIG. 1e PRIOR ART

At this point, as shown in FIG. 1*e*), liner running tool 32 is raised and additional cement cleanout fluid is injected to push excess cement through production tubing 20 to discharge as shown at line 42. This is normally the completion of the cementing job using a tubular member which contains no wire or other obstruction. As previously indicated, the presence of a wire or any other obstruction makes it impossible to use the coil tubing wiper dart to accomplish this process.

The cement cleanout fluid used is typically a material such as biopolymer but can be any fluid chosen by the operator. One suitable cement cleanout fluid for viscosity and suspension control in drilling operations is marketed by CP KELCO US, Inc. under the trademark BIOZAN. The term BIOZAN is identified by Hawleys Condensed Chemical Dictionary, revised by Richard J. Lewis, Sr., Van Nostrand Reinholt Company, New York, 12th Edition, page 147, as welan gum.

Figure 2:
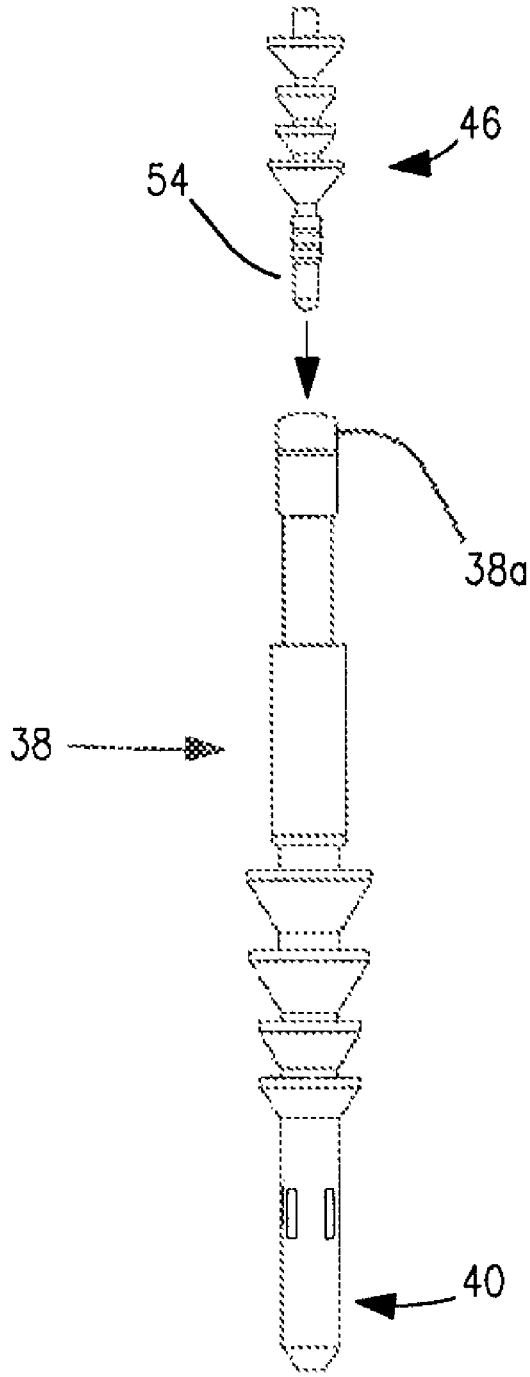
FIG. 2 is a schematic diagram of a liner wiper plug and a tubular member wiper dart positioned as they are injected, with the tubular member wiper dart being positioned to couple with liner wiper plug.

In FIG. 2 coil tubing wiper dart 46 is shown positioned with its lower mating guide 54 above liner wiper plug 38, which has an arcuate lower end 40 and includes polymeric wiper surfaces as shown. As shown, coil tubing wiper dart 46 mates with liner wiper plug 38 at its upper end 38*a*).

Figure 3A:
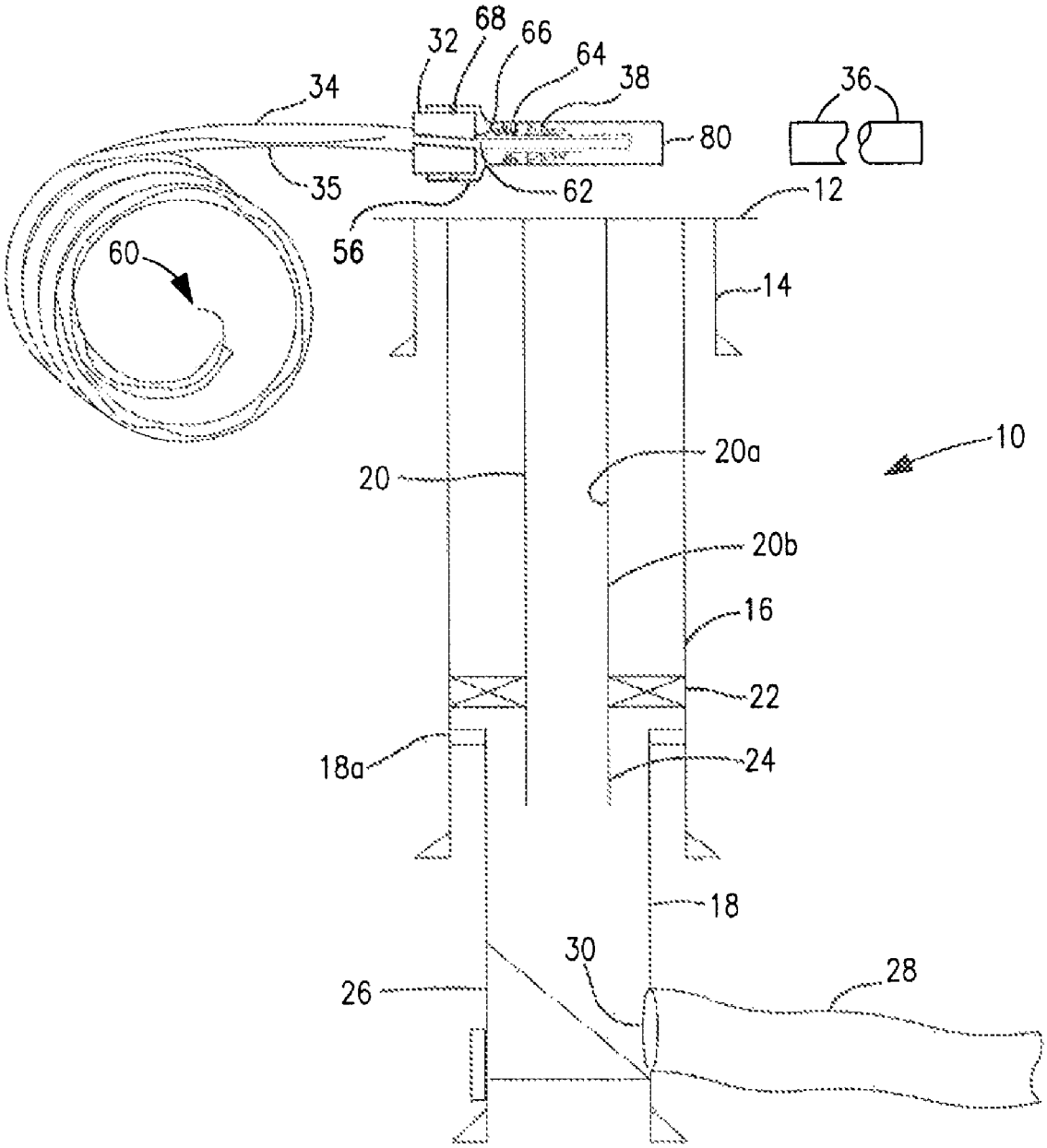
FIGS. 3*a*)-3*f*) are schematic diagrams of various steps according to an embodiment of the present invention.

In the practice of the present invention, for the embodiment shown in FIG. 3*a*) a tubular member 34 (which may be coiled tubing) containing a wire 60 (or other obstruction) is used to convey the liner 36 into the open hole 28. Liner running tool 32, capable of exhausting contaminated fluids to the annulus above top of liner 36, is positioned on tubular member 34 and includes an extension 62 which runs through liner wiper plug 38. Liner wiper plug 38, with a mounting for shear pins 64, is attached to the lower portion of deployment sleeve assembly 56. A spring loaded cover 66 is attached to the upper end of liner wiper plug 38. Liner running tool 32 is releasably attached to deployment sleeve 56 which has a connector 80 on its bottom end to attach to jointed pipe liner 36. A neck or collar-type transition 37 as shown on FIG. 3*b*) provides a transition on the deployment sleeve 56 if the dimensions of the liner running tool 32 differ relative to those of the liner 36.

Figure 3B:
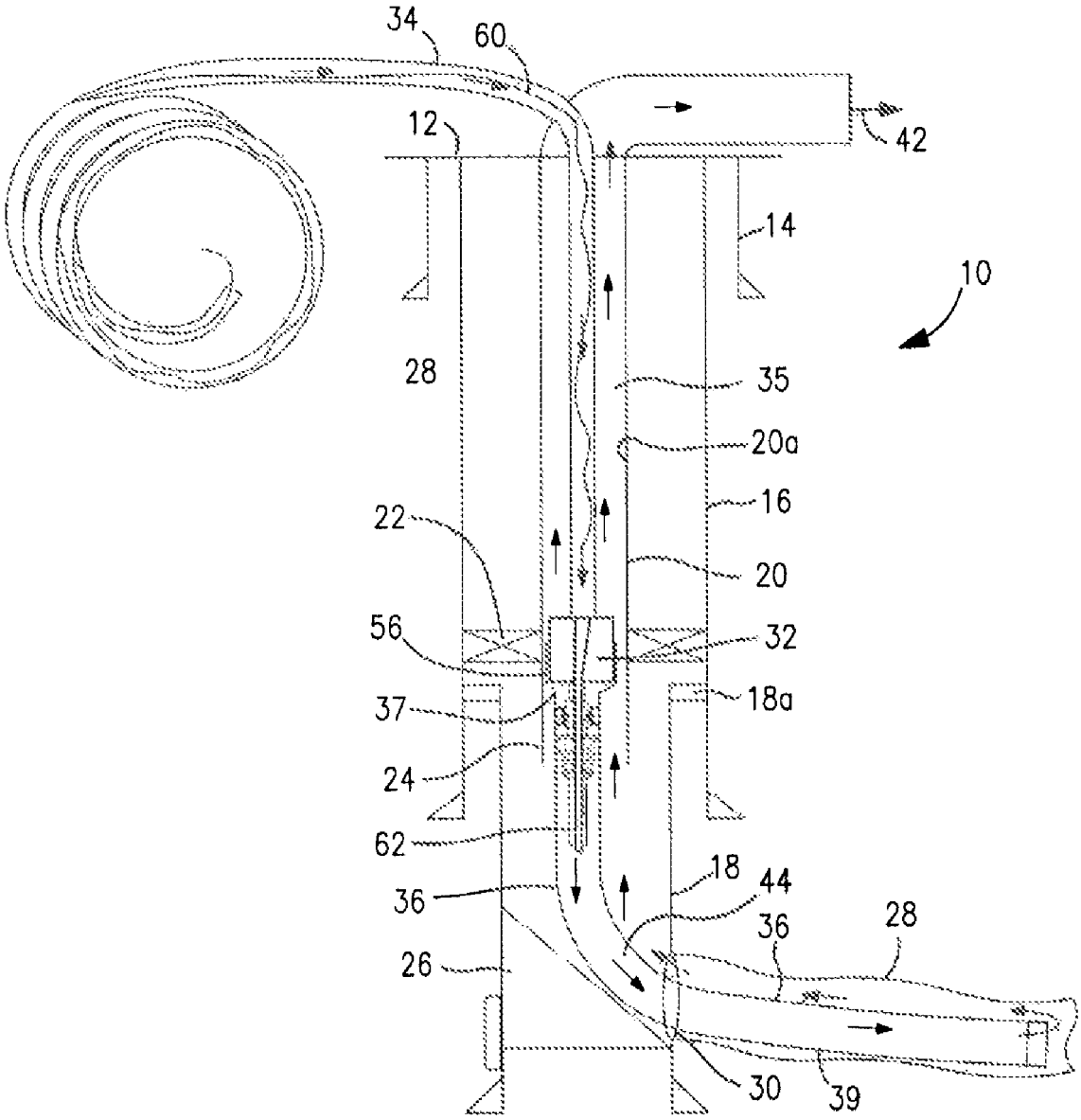

The wellbore shown in FIG. 3*a*) is otherwise substantially the same as that shown in FIG. 1*a*). As the cement job begins, as shown in FIG. 3*b*), the tubular member 34, including wire 60, which may be a single wire, a cable, a bundle of wires or the like may or may not be connected to the assembly discussed above. At this point, drilling mud 44 is being injected, as previously discussed, to pass downwardly through the liner around outside 39 of the liner and back up the production tubing by coil annulus to discharge to mud pits or the like, as shown by arrow 42.

Figure 3C:
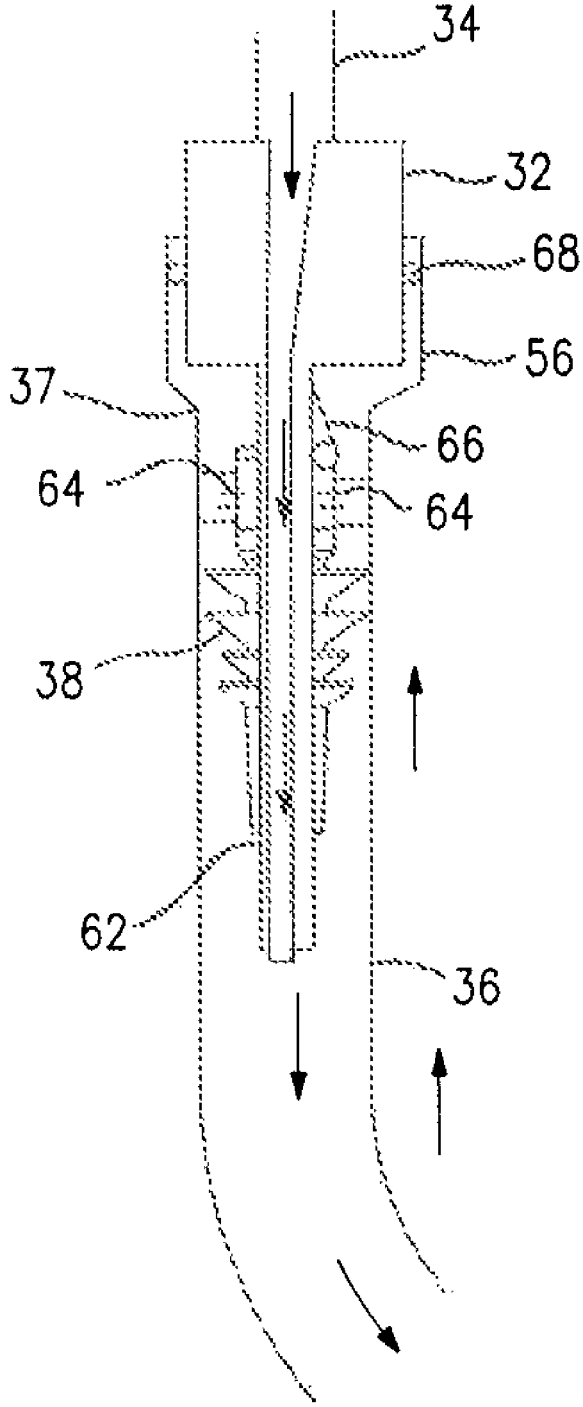

An enlarged view of the liner running tool 32 apparatus connected to the end of tubular member 34 is shown in FIG. 3*c*).

Figure 3D:
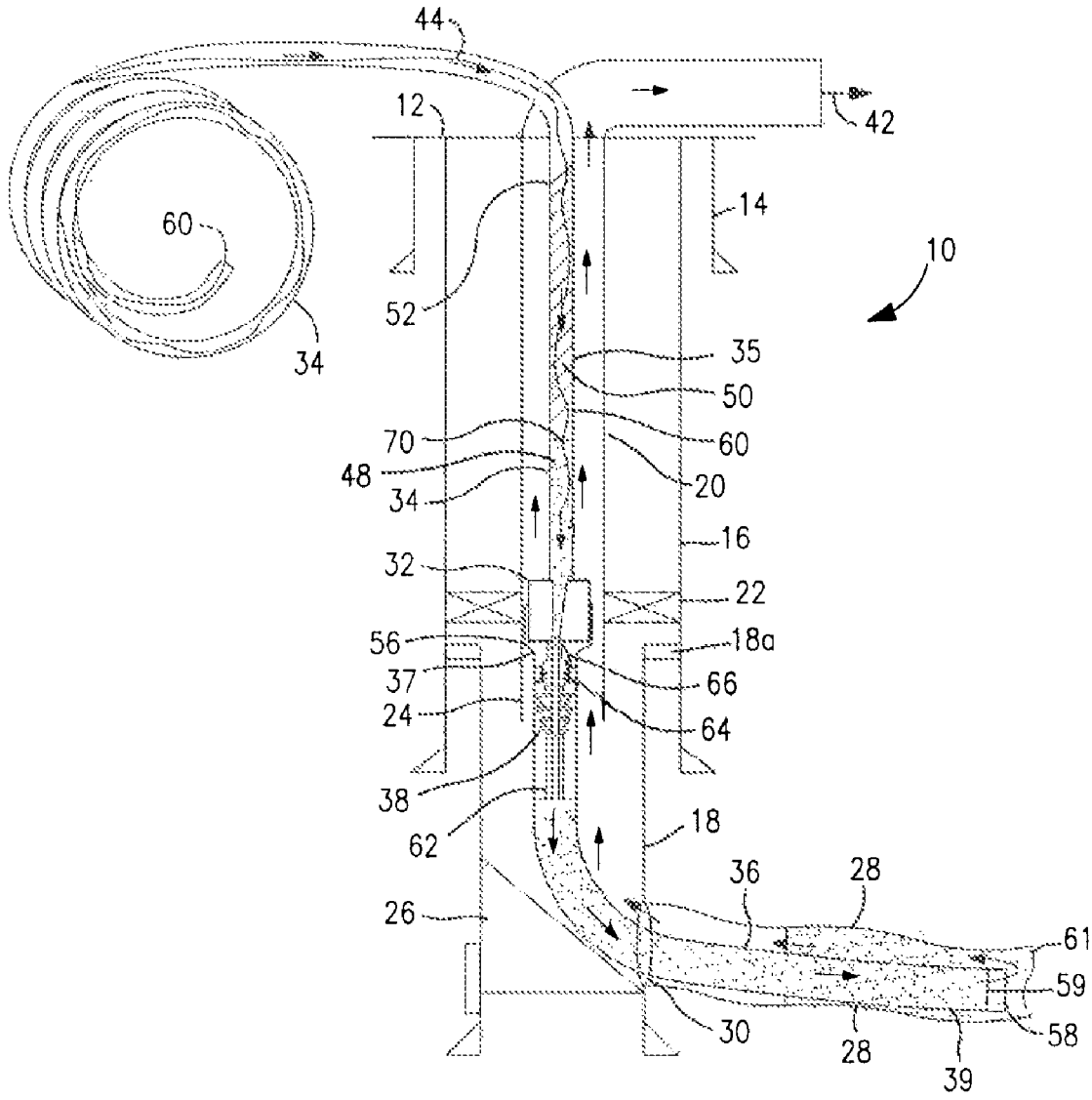

In FIG. 3*d*) cement injection has begun and cement is being passed through liner running tool 32 and liner wiper plug 38. The cement has partially filled liner 36 and the space around liner 36 between an outside 39 of liner 36 and the inside of open hole 28. The tubular member 34 includes an interface 70 between cement 48 and cement cleanout fluid 50. At interface 70 some mixing will occur and some of the cement will be contaminated by the cement cleanout fluid so that it will not set. Similarly, at interface 52, the cement cleanout fluid is in contact with drilling mud 44 positioned in tubular member 34, although other fluids could also be used to push the cement cleanout fluid and cement into the open borehole 28 if desired.

Figure 3E:
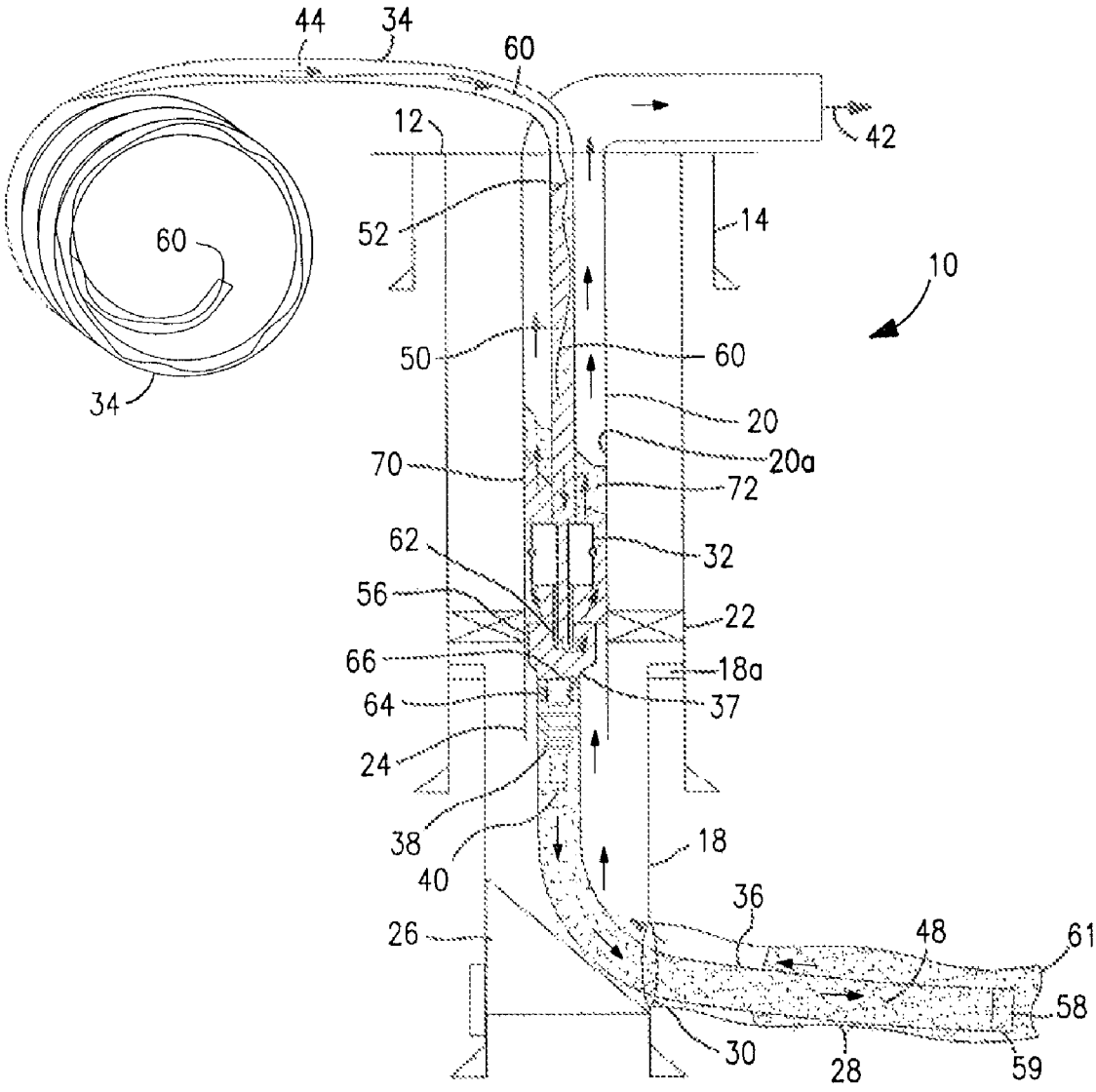

In FIG. 3*e*) the liner running tool 32 has been lifted from deployment sleeve 56 prior to injection of all of the cement past the running tool. It will be noted that upon withdrawal of extension 62 from liner wiper plug 38, spring loaded cover 66 has closed. Accordingly at this point no fluids can pass into liner 36 past liner wiper plug 38. Pumping is resumed down tubing member 34 and cement cleanout fluid 50 pushes cement contaminated with cleanout fluid 72 into the production tubing through the coil tubing annulus formed between the outside surface 35 of tubular member 34 and inside surface 20*a* of production tubing 20. Further pumping down tubing member 34 places clean cement cleanout fluid 50 into the production tubing through such coil tubing annulus and moves contaminated fluid 72 up the production tubing and ultimately to discharge through line 42 to the rig pits or disposal.

Figure 3F:
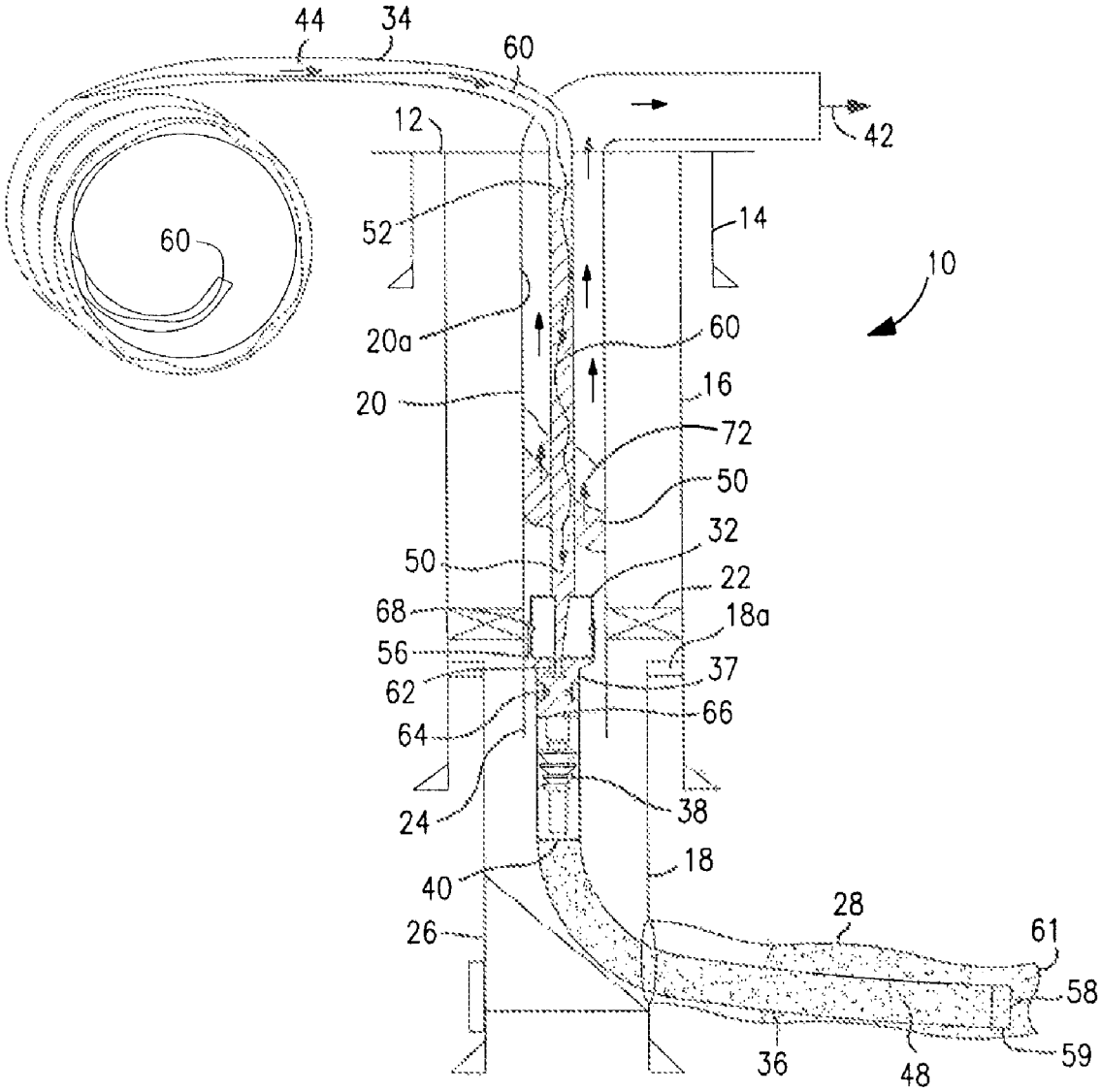

In FIG. 3*f*) the contaminated cement 72 has been pushed up production tubing 20 through such coil annulus as previously described and liner running tool 32 has been repositioned in deployment sleeve 56. At this point, pressure is applied by increasing the pressure in coiled tubing 34 so that liner wiper plug 38 is broken free of shear pins 64 and begins to pass downwardly through liner 36.

Figure 3G:
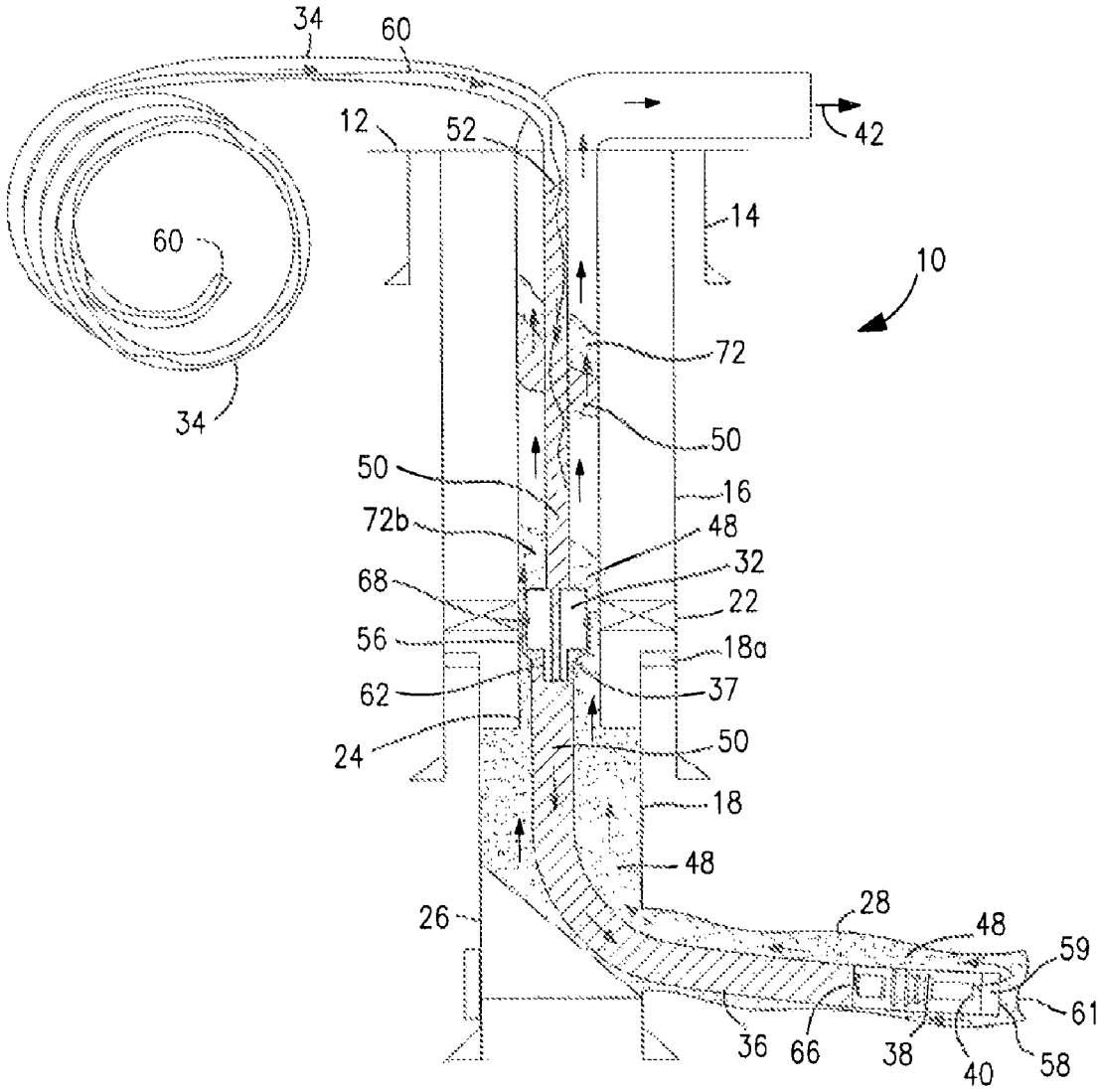

In FIG. 3*g*) liner wiper plug 38 has reached toe end 59 of liner 36. All of the cement has been pushed out of liner 36 into the annular space around liner 36 and some excess cement 72*b* has been pushed up to and past liner running tool 32.

Figure 3H:
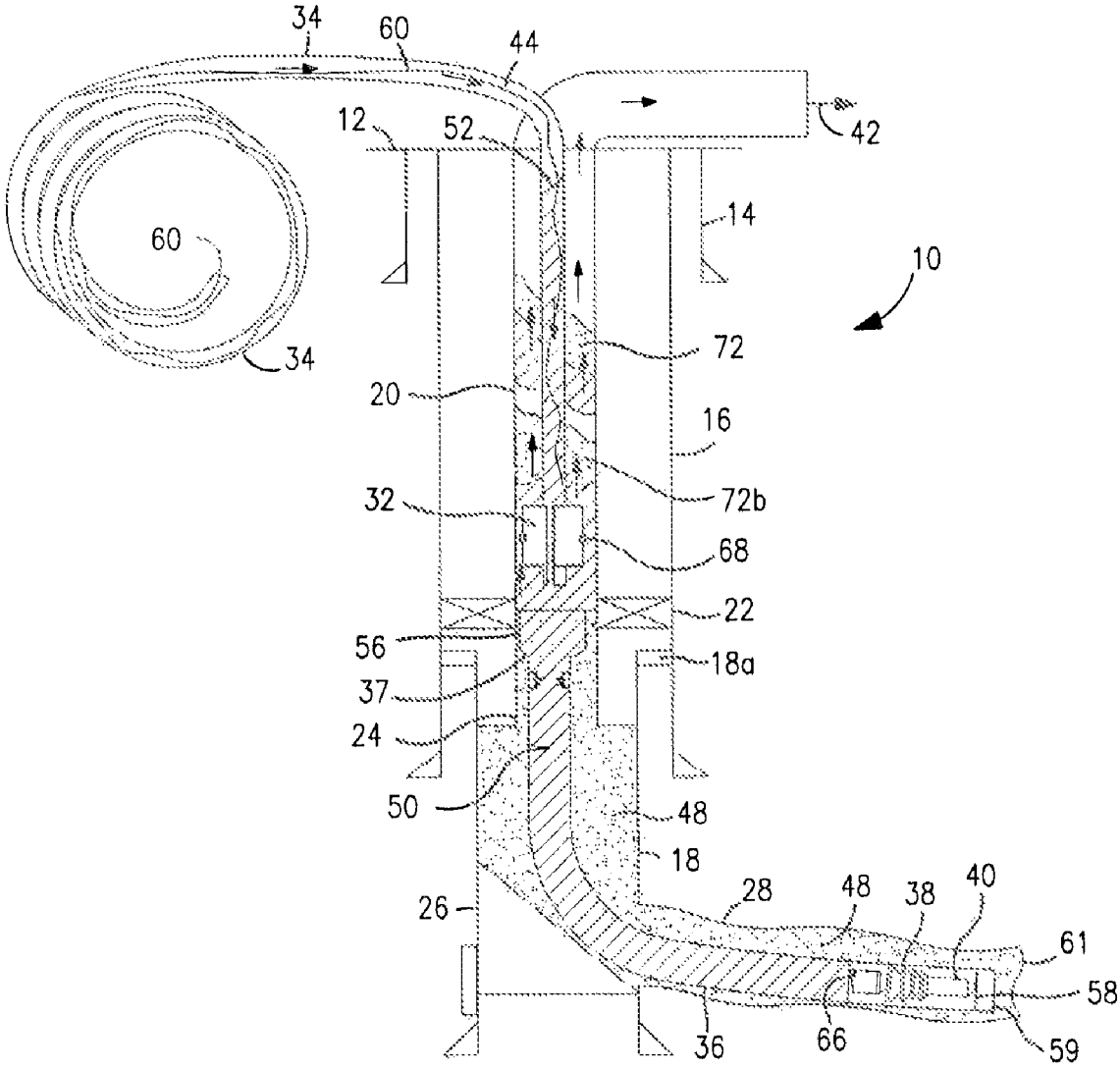

At this point in FIG. 3*h*), liner running tool 32 is lifted and additional cement cleanout fluid is injected. This injected fluid pushes the now contaminated excess cement 72*b* and the contaminated cement 72 previously passed upwardly through production tubing 20 by the coil annulus previously described. During this operation, there is no flow in liner 36. The presence of liner wiper plug 38 ensures that no flow of cement cleanout fluid passes plug 38. The cement job is now complete.

The tubular member used has been cleaned by the passage of the cement cleanout fluid and is now ready for use to drill an additional open hole or for other purposes requiring the wire bundle in the tubular member. Typically the tubular member includes a bundle of wires or a multi-conductor cable or the like. The elimination of the tubing coil change is a significant advantage and allows for expedited operation and greatly reduced costs. The use of the present method results in efficient and effective liner cementing jobs at a fraction of the previously necessary cost.

The practice of the method is facilitated by use of an apparatus for cementing a liner in an open borehole extending from a wellbore and produced by drilling using a drilling apparatus including a tubular member having at least one obstruction in the tubular member, a body and configured for mating connection to the liner and including an extension having a passageway through the liner running tool and the extension and a liner wiper plug having an opening extending therethrough with the extension extending through the opening, a cover positioned on the liner wiper plug and adapted to cover the opening when the extension is withdrawn and a releasable retaining apparatus carried on the extension between the liner wiper plug and the body and adapted to releasably retain the liner wiper plug in a selected position in the liner.

The liner running tool includes a body configured for mating connection with the liner. The liner running tool contains passageways to enable the discharge of excess cement and cement contaminated with cement cleanout fluid through the sides, bottom or top of the liner running tool into the production tubing by coiled tubing annulus with or without disengaging the liner running tool. Alternatively, the liner running tool may employ a device therein operable to close the passageway therein and discontinue fluid flow therethrough, such as by a mechanical, electrical, or hydraulically-operated valve. The liner typically includes, as a portion of the liner, a deployment sleeve shown at 56 which enables the liner running tool to be configured for mating engagement to the deployment sleeve in both a sealed or unsealed configuration as shown by seals 68. The extension from the liner running tool includes a passageway through the liner running tool and the extension extends through the liner wiper plug having an opening extending therethrough with the extension extending through the opening. The apparatus also includes a cover positioned on the liner wiper plug and biased to cover the opening in the wiper plug when the extension is withdrawn and a releasable retaining apparatus carried on the extension between the liner wiper plug and the body or on the liner wiper plug.

The releasable retaining apparatus may be carried on either the extension, the liner running tool, the deployment sleeve assembly or the liner wiper plug and is adapted to releasably retain the liner wiper plug in a preselected position in the liner. As noted previously the liner typically includes a deployment sleeve on its top end. The releasable retaining apparatus typically includes a plurality of shear pins mounted so that they can be sheared by the imposition of an additional pressure at a selected level on the closed liner wiper plug. Alternatively the releasable retaining apparatus may be electronically operated. This is accomplished as shown specifically in FIG. 3*e*) and FIG. 3*f*).

The extension is typically at least partially retracted into the body as shown at FIGS. 3*e*)-3*h*). This retraction is necessary to allow the liner running tool 32 to move back into engagement with deployment sleeve 56 for the operation shown in FIG. 3*h*).

This apparatus is uniquely adapted to the performance of the method according to embodiments as previously described. The apparatus is adapted to accomplish the downhole operations necessary to enable the use of the wire-containing tubular member to perform the cementing job. The use of the this tool is specifically adapted to performing the required steps which must be performed in the order shown in order to achieve the desired result without contaminating fluids at inappropriate times and in inappropriate locations.

The present invention as described above has enabled the use of tubular member containing at least one wire or other obstruction to accomplish cementing jobs which have previously required the use of a second tubular member containing no wire or obstruction. As mentioned previously, this is a substantial time and cost savings to oil field operations.

The movement of the liner running tool, the selection of a discharge from the liner running tool through either the top, sides or bottom of the liner running tool, the closing of the liner wiper plug, the retention and release of the liner wiper plug and other related functions shown as mechanically or hydraulically performed can also be electronically performed and may be desirably performed electronically. The mechanical and hydraulic operation has been shown herein for simplicity.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for cementing a liner having a (heel) top end and a (toe) bottom end positioned in an open borehole extending from a wellbore produced by drilling with a drilling apparatus including a tubular member having at least one obstruction in the tubular member, the method comprising:

a) injecting cement into the liner through the tubular member and a liner wiper plug located at the top of the liner and having an opening therethrough which permits fluid communication between the tubular member and the liner;

b) passing a cement cleanout fluid through the tubular member to move the cement through the tubular member;

c) the cement and cement cleanout fluid forming a cement cleanout fluid/contaminated cement fluid interface material, to a selected distance upstream from the top end of the liner;

d) stopping injection before any cement cleanout fluid/contaminated cement enters the liner;

e) closing the flow path of fluids down the liner at the top end of the liner at or near the liner wiper plug;

f) discharging the cement and cement contaminated by the cement cleanout fluid remaining in the tubular member above the liner wiper plug into an annulus between an outer surface of the tubular member and an inner surface of the wellbore above the top end of the liner;

g) shutting off flow to the annulus, h) releasing the liner wiper plug;

i) pushing the liner wiper plug to the toe end of the liner; and j) reestablishing flow to the annulus above the top end of the liner so additional fluid passed by the tubular member can fully remove contaminated cement from the wellbore.

2. The method of claim 1 wherein the cement cleanout fluid is an aqueous biopolymer solution.

3. The method of claim 2 wherein the biopolymer comprises welan gum.

4. The method of claim 1 wherein the wiper plug is open during the injection of the cement into the liner.

5. The method of claim 1 wherein the cement cleanout fluid is in contact with the cement in the tubular member during injection of the cement into the liner.

6. The method of claim 1 wherein the cement contaminated with cement cleanout fluid and excess cement are removed from the well by injection of additional cement cleanout fluid.

7. The method of claim 1 wherein the tubular member is a tubular member including at least one wire.

8. The method of claim 1 wherein the tubular member is a drillpipe having an obstruction in the drillpipe.

9. The method of claim 1 wherein the annulus is between the outer surface of the tubular member and an inside surface of a casing or a production tubing located within the wellbore.

10. The method of claim 1 wherein the annulus is between the outer surface of the tubular member and an inner surface of a production tubing located within the wellbore.

11. A method for cementing a liner in position in an open borehole extending from a wellbore and produced by drilling using a drilling apparatus including a tubular member having at least one obstruction in the tubular member, the cement being supplied through the tubular member, the method comprising:

a) positioning a liner in the open borehole, the liner extending from a toe end of the liner near a toe end of the open borehole to a deployment sleeve being positioned on a top end of the liner and located within casing or production tubing, the deployment sleeve being adapted to matingly connect to a liner running tool, the liner running tool including an extension having a passageway through the liner running tool and the extension and a liner wiper plug having an opening extending therethrough with the extension extending through the opening, a cover biased to cover the opening when the extension is withdrawn and a releasable retaining apparatus adapted to releasably retain the liner wiper plug in a selected position in the liner;

b) positioning the liner running tool in fluid communication with the deployment sleeve;

c) injecting cement into the liner through the tubular member and the liner running tool in a selected amount greater than required to fill an annular space between an outside of the liner and the inside of the open borehole and to a level above the deployment sleeve;

d) injecting a cement cleanout fluid in contact with the cement through the tubular member in an amount sufficient to displace the selected amount of cement into the liner and the annular space outside the liner;

e) stopping injection of the cement cleanout fluid prior to injecting cement cleanout fluid through the liner wiper plug, f) removing the liner running tool to a position above the deployment sleeve, g) withdrawing the extension from the liner wiper plug, h) closing the cover and passing additional cement cleanout fluid through the passageway to pass excess cement and cement contaminated with cement cleanout fluid up the wellbore and outside the tubular member;

i) retracting the extension to a suitable length to permit positioning the liner running tool in the deployment sleeve and releasing the liner wiper plug;

j) injecting additional cement cleanout fluid through the liner running tool to move the liner wiper plug to the toe end of the liner and fill the liner upstream of the liner wiper plug with cement cleanout fluid; and, k) releasing the liner running tool from the deployment sleeve.

12. The method of claim 11 wherein the liner wiper plug is released by increasing the pressure above the liner wiper plug.

13. The method of claim 11 wherein the releasable retaining apparatus is at least one shear pin and wherein the liner wiper plug is released by increasing the pressure above the liner wiper plug and shearing the at least one shear pin.

14. The method of claim 11 wherein the cement cleanout fluid is an aqueous biopolymer fluid.

15. The method of claim 14 wherein the biopolymer comprises welan gum.

16. The method of claim 11 wherein the liner running tool includes at least one opening in a side or a top of the liner running tool which is adapted to discharge at least one of excess cement and cement contaminated by cement cleanout fluid.

17. The method of claim 16 wherein the discharge is controlled by an electronic signal.

18. An apparatus for cementing a liner in an open borehole extending from a wellbore and produced by drilling using a drilling apparatus including a tubular member having at least one obstruction in the tubular member, the apparatus comprising:

a liner running tool adapted to be run down the wellbore on the tubular member and including a body configured for mating connection to the liner, the body including an extension having a passageway through the liner running tool and the extension to permit fluid flow through the liner running tool;

a releasably mounted liner wiper plug having an opening extending therethrough and adapted to receive the extension of the body extending through the opening on the liner wiper plug; and a selectively closed cover for said opening positioned on the liner wiper plug and adapted to cover the opening on the liner wiper plug when the extension of the body is withdrawn from the opening.

19. The apparatus of claim 18 wherein the body includes a seal which is adapted to sealingly connect the liner running tool to the liner.

20. The apparatus of claim 18 wherein the apparatus further comprises a releasable retaining apparatus comprising at least one shear pin mounted in a fixture adapted to engage a wall of the liner at a selected location and retain the liner wiper plug at the selected location in the liner.

21. The apparatus of claim 18 wherein the extension is at least partially retractable into the body.

22. The apparatus of claim 18 wherein the liner wiper plug sealingly and slideably engages an inside of the liner.

23. A method for cementing a liner having a (heel) top end and a (toe) bottom end in position in an open borehole extending from a wellbore produced by drilling with a drilling apparatus including a tubular member having at least one obstruction in the tubular member, the tubular member having a discharge end fluidly connected to a passageway in a liner wiper plug positioned within the liner at the top end of the liner such that fluids conveyed by the tubular member may be injected into the liner, the liner wiper plug having a valve operable to discontinue flow through the passageway, the tubular member and the heel end of the liner being located within the wellbore that extends upwardly such that fluids from the well may be conveyed to the earth's surface through the wellbore, the method comprising:

a) injecting cement into the liner through the tubular member and the liner wiper plug;

b) passing a cement cleanout fluid through the tubular member to move the cement through the tubular member such that an interface between the cement and the cement cleanout fluid is a selected distance upstream from the toe end of the liner;

c) discontinuing fluid communication between the tubular member and both the heel end of the liner and the liner wiper plug and closing the valve on the liner wiper plug positioned in the heel end of the liner;

d) passing the cement cleanout fluid through the tubular member to discharge the cement above the selected distance and cement contaminated by the cement cleanout fluid from the tubular member; and e) reestablishing fluid communication between the tubular member and the heel end of the liner and passing additional cement cleanout fluid through the tubular member to pass the liner wiper plug through the liner.

24. The method of claim 23 wherein the tubular member and the heel end of the liner are located within casing or production tubing in the wellbore.

25. The method of claim 23 wherein the tubular member and the heel end of the liner are located within production tubing in the wellbore.

26. The method of claim 23 wherein the interface is located in the tubular member upstream of the liner wiper plug.

27. The method of claim 23 wherein the cement cleanout fluid is an aqueous biopolymer solution.

28. The method of claim 27 wherein the biopolymer comprises welan gum.

29. The method of claim 23 wherein the valve of the liner wiper plug is open during the injection of the cement into the liner.

30. The method of claim 23 wherein the cement cleanout fluid is in contact with the cement in the tubular member during injection of the cement into the liner.

31. The method of claim 23 wherein the cement contaminated with cement cleanout fluid at the interface and excess cement are removed from the well by injection of additional cement cleanout fluid.

32. The method of claim 23 wherein the tubular member is a tubular member including at least one wire.

33. The method of claim 23 wherein the tubular member is a coiled tubing having an obstruction comprised of wires.

34. The method of claim 23 wherein the tubular member is drillpipe having an obstruction therein.

35. A method for cementing a liner in position in an open borehole extending from a wellbore and produced by drilling using a drilling apparatus including a tubular member having an outside surface and having at least one obstruction in the tubular member, the cement being supplied through the tubular member which is positioned within production tubing having an inside surface and extending upwardly through the wellbore such that fluids from the well may be conveyed to the earth's surface by the production tubing, the method comprising:

a) positioning a liner in the open borehole, the liner extending from a toe end of the liner near a toe end of the open borehole to a deployment sleeve positioned on a heel end of the liner and located in the production tubing, the deployment sleeve being adapted to sealingly connect to a liner running tool, the liner running tool including an extension and having a passageway through the liner running tool and the extension, the heel end of the liner having a liner wiper plug with an opening therein extending through the liner wiper plug so that fluids may be conveyed therethrough, the extension of the liner running tool being in fluid communication with and extending through the opening so that fluids conveyed by the tubular member may be conveyed through the passageway and the opening through the liner wiper plug, the liner wiper plug having a cover biased to cover the opening and restrict flow of fluids through the opening when the extension is withdrawn from the opening and a releasable retaining apparatus adapted to releasably retain the liner wiper plug in a selected position in the liner;

b) positioning the liner running tool in fluid communication with the deployment sleeve;

c) injecting cement into the liner through the tubular member and the liner running tool such that cement is at a level within the tubular member above the deployment sleeve;

d) injecting a cement cleanout fluid in contact with the cement through the tubular member to displace the selected amount of cement into the liner and the annular space outside the liner within the open borehole;

e) stopping injection of the cement cleanout fluid prior to injecting cement cleanout fluid through the liner wiper plug, f) withdrawing the extension from the liner wiper plug and closing the cover to the opening of the liner wiper plug;

g) passing additional cement cleanout fluid through the passageway to displace excess cement and cement contaminated with cement cleanout fluid;

h) reestablishing fluid communication between the liner running tool and the deployment sleeve;

i) injecting additional cement cleanout fluid through the liner running tool to move the liner wiper plug to the toe end of the liner and, j) releasing the liner running tool from the deployment sleeve and continuing to inject additional cement cleanout fluid to move contaminated cement up the wellbore.

36. The method of claim 35 wherein the liner wiper plug is released by increasing the pressure in the tubular member above the liner wiper plug.

37. The method of claim 35 wherein the releasable retaining apparatus is at least one shear pin and wherein the liner wiper plug is released by increasing the pressure in the tubular member above the liner wiper plug and shearing the at least one shear pin.

38. The method of claim 35 wherein the cement cleanout fluid is an aqueous biopolymer fluid.

39. The method of claim 38 wherein the biopolymer comprises welan gum.

40. The method of claim 35 wherein the liner running tool includes at least one opening in a side or a top of the liner running tool which is adapted to discharge at least one of excess cement and cement contaminated by cement cleanout fluid.

41. The method of claim 35 wherein the discharge is controlled by an electronic signal.

* * * * *